US009655488B2

(12) United States Patent
Cordes et al.

(10) Patent No.: US 9,655,488 B2
(45) Date of Patent: May 23, 2017

(54) CATCH DEVICE FOR A VACUUM CLEANER SUCTION PIPE

(71) Applicant: fischer Rohrtechnik GmbH, Achern-Fautenbach (DE)

(72) Inventors: Martin Cordes, Sundern (DE); Stephan Cordes, Arnsberg (DE)

(73) Assignee: fischer Rohrtechnik GmbH, Achern-Fautenbach (DE)

( * ) Notice: Subject to any disclaimer, the term of this patent is extended or adjusted under 35 U.S.C. 154(b) by 3 days.

(21) Appl. No.: 14/254,043

(22) Filed: Apr. 16, 2014

(65) Prior Publication Data

US 2014/0306444 A1 Oct. 16, 2014

(30) Foreign Application Priority Data

Apr. 16, 2013 (DE) ..... 10 2013 206 773
Jun. 21, 2013 (DE) ..... 10 2013 211 766

(51) Int. Cl.
*A47L 9/24* (2006.01)

(52) U.S. Cl.
CPC ..... *A47L 9/242* (2013.01)

(58) Field of Classification Search
CPC ..... A47L 9/244
USPC ..... 285/7, 303
See application file for complete search history.

(56) References Cited

U.S. PATENT DOCUMENTS 3,159,412 A 12/1964 Descarries
5,884,358 A 3/1999 Kim
5,954,370 A 9/1999 Pietersen
6,345,408 B1 2/2002 Nagai et al.
6,431,607 B1 * 8/2002 Kittelmann et al. ..... 285/7
6,742,220 B2 6/2004 Nagai et al.
6,832,784 B1 12/2004 Chen
7,155,774 B2 * 1/2007 Jung ..... 285/7
7,168,127 B2 1/2007 Genoa et al.
2002/0042968 A1 4/2002 Worwag
2002/0053114 A1 5/2002 Oh
2003/0163891 A1 9/2003 Nagai et al.

FOREIGN PATENT DOCUMENTS

CN 101828891 A 9/2010
DE 3931639 A1 4/1991
DE 69618168 T2 8/2002
DE 69934264 T2 6/2007
EP 1935310 B1 6/2008
EP 1768536 B1 12/2009
GB 2324712 A 11/1998
WO WO 0067631 A1 * 11/2000

* cited by examiner

*Primary Examiner* — David E Bochna
(74) *Attorney, Agent, or Firm* — David S. Safran

(57) ABSTRACT

A catch device (1) for connecting a handle to a vacuum cleaner suction pipe (2), the catch device (1) being mountable on one end region of a vacuum cleaner suction pipe (2), and having at least one sleeve (3), at least one lever button (4) and at least one reset spring (7), the lever button (4) having a catch projection (8) and a pivot axle (9) for the lever button. The catch device (1) reduces the effort for mounting on a vacuum cleaner suction pipe (2) the provision of a clamp element (11) that is positively connected to the sleeve (3), the pivot axle (9) being pivotally held between the clamp element (11) and the sleeve (3).

11 Claims, 5 Drawing Sheets

CATCH DEVICE FOR A VACUUM CLEANER SUCTION PIPE

BACKGROUND OF THE INVENTION

Field of the Invention

The invention relates to a catch device for connecting a handle to a vacuum cleaner suction pipe, the catch device being mountable in one end region of a vacuum cleaner suction pipe, with at least one sleeve, at least one lever button and at least one reset spring, the lever button having one catch projection and one pivot axis. Furthermore, the invention relates to a vacuum cleaner suction pipe with a catch device.

Description of Related Art

These catch devices are known in the prior art in a number of embodiments and are conventionally attached in one end region to a vacuum cleaner suction pipe. In this way, the vacuum cleaner suction pipe can be connected via the catch device to a handle of a vacuum hose and thus, to the vacuum cleaner itself. To connect the handle positively to the vacuum cleaner suction pipe, for example, there is a catch recess on the handle which locks positively to the catch projection of the lever button. For connection purposes, for example, the end of the handle is inserted into the catch device or vacuum cleaner suction pipe, as a result of which the recess can interact with the catch projection. The catch projection yields laterally when the handle is pushed in by the pivotally arranged lever button pivoting back around the pivot axis, and thus, releasing the handle to be pushed in. The reset spring then causes a reset of the lever button, and thus, of the catch projection into a locking position.

The catch devices which are known from the prior art have the disadvantage that the catch devices are mounted directly on the vacuum cleaner suction pipe, and thus, the mounting is very complex.

SUMMARY OF THE INVENTION

Therefore, a primary object of this invention is to devise a catch device which reduces the effort for mounting a handle or other components on a vacuum cleaner suction pipe.

This object is first of all achieved essentially in that there is a clamp element in the catch device that is positively connected to a sleeve, and that a lever button is pivotally held between the clamp element and the sleeve.

The catch device can be mounted in an end region of the vacuum cleaner suction pipe, the sleeve of the catch device surrounding the vacuum cleaner suction pipe, preferably around its entire circumference. The vacuum cleaner suction pipe preferably comprises at least an outer pipe and an inner pipe, the outer pipe and the inner pipe being able to telescope relative to one another so that the length of the vacuum cleaner suction pipe can be variably adjusted. The catch device is used, for example, to connect a handle to the vacuum cleaner suction pipe, but it is also provided that other components are connected to the vacuum cleaner suction pipe, for example, a vacuum hose without the handle.

The catch device comprises a sleeve which is used preferably as a carrier for the other parts, specifically at least one lever button and at least one reset spring. The lever button is held in the sleeve to be able to pivot around a pivot axis so that the catch projection of the lever button can be moved out of a locking position into a release position. The clamp element is positively connected to the sleeve and is arranged on the sleeve such that the lever button with its pivot axis is pivotally held between the clamp element and the lever button. To mount the catch device, the lever button can be easily inserted into the sleeve, for which the lever button is guided partially from the outside through an opening into the sleeve. The pivot axis is positioned in a support region in doing so. Preferably, the lever button is positively held between the clamp element and the sleeve in the mounted state. In addition, the reset spring is preferably positioned between the sleeve and the lever button. Finally, the clamp element is positively fastened on the sleeve, preferably by the clamp element locking with at least one catch hook on a catch region of the sleeve.

Due to the clamp element, the lever button is located in a fixed position with reference to the sleeve, and in any case, such that the lever button can be pivoted within the scope of a pivoting motion. The lever button pivots preferably between a locking position in which the catch projection of the lever button is in a locked state and when the handle is present is locked to it, and a release position in which the catch projection of the lever button is not locked and when the handle is present, it can be released.

This invention has the advantage that the lever button and the reset spring, even when the catch device is not mounted on the vacuum cleaner suction pipe, are captively held on the sleeve. In this way, the whole catch device can be pre-mounted with all of its parts, and then, can be mounted on the vacuum cleaner suction pipe, as a result of which the mounting process is simplified overall. Moreover, there is the advantage that, when the catch device is detached, for example, by a fall, not all parts of the catch are separated, but are held together by the clamp element so that the catch device can be easily remounted.

In particular, advantageous reliability of the fastening of the lever button on the sleeve can be achieved, according to a first configuration, by the clamp element having two catch flanks which are located parallel to one another and by the sleeve having two catch regions which correspond to the catch flanks, especially by the catch flanks running parallel to the longitudinal extension of the sleeve. Consequently, the clamp element is positively connected to the corresponding catch regions on the sleeve, for example, locked, using the two catch flanks which are located parallel to one another. To do this, the catch flanks have, in particular, a catch projection which runs over their entire longitudinal extension and which at least partially extends behind the catch region so that a positive connection between the clamp element and the sleeve is accomplished. Alternatively, it is also provided that the catch flanks each have at least one recess which a respective catch projection of the sleeve engages.

Due to the arrangement of two catch flanks which run parallel to one another and whose catch projections are preferably oriented oppositely to one another, the clamp element acquires advantageous stability when the lever button is fastened on the sleeve. In particular, the catch flanks are oriented parallel to the longitudinal extension of the sleeve so that the catch flanks are arranged orthogonally to the orientation of the pivot axis of the lever button.

The stability of the catch device can be increased according to another configuration by the clamp element being located on the inside of the sleeve so that the clamp element is facing the vacuum cleaner suction pipe in the mounted state. The lever button is preferably inserted from the outside at least partially through an opening into the sleeve, then the clamp element being advanced from the inside and being locked to the sleeve. The lever button is consequently advanced from the outside, the clamp element from the inside, onto the sleeve. Arranging the clamp element on the inside of the sleeve prevents parts of the catch device on the vacuum cleaner suction pipe from being detached in the mounted state of the catch device. Dismounting of the individual parts of the catch device from the sleeve is consequently only possible after dismounting the catch device from the vacuum cleaner suction pipe.

To improve the pivoting capacity of the lever button, according to another configuration, it has been ascertained to be advantageous if it is provided that at least one first part of a guide bush for the pivot axis is made on the sleeve and at least one second part of a guide bush is made on the clamp element so that the pivot axis is guided between the clamp element and the sleeve in the guide bush in the mounted state. At least one first part of a guide bush for the pivot axis is made on the sleeve, it also being provided that two oppositely arranged first parts of a guide bush are made so that the pivot axis of the lever button is guided on two supports. The two first parts of one guide bush advantageously lie on one common imaginary axis.

The first part of the guide bush for the pivot axis is made, for example, as a half shell into which the pivot axis of the lever button is inserted. The second part of the half shell, specifically the second part of the guide bush, is located on the clamp element and is also made as a half shell so that, in the mounted state of the clamp element, a guide bush which surrounds the pivot axis is made preferably on the two sides of the pivot axis. The guide bush need not surround the pivot axis completely around its circumference, guidance such that the pivot axis cannot emerge from the guide bush being sufficient. This takes place, for example, with two oppositely arranged shell elements which cover at least part of the circumference of the pivot axis. Consequently, there are a total of four half shells—shell elements—which ensure reliable guidance of the pivot axis of the lever button in the mounted state of the catch device. The guide bush or guide bushes are closed around the pivot axis by the mounting of the clamp element on the sleeve, and thus, hold the lever button pivotally in its position.

Advantageous resetting of the lever button into the locking position according to a second configuration can be achieved in that the reset spring is supported between the sleeve and the lever button and in that the reset spring always seeks to reset the lever button into the locking position. The reset spring is made, for example, as a helical spring, cup spring or leaf spring and is located between the sleeve and the lever button such that the reset spring always seeks to reset the lever button into a locking position. Here, it is provided that the reset spring is made as a helical spring and is arranged such that it causes a torque on the pivot axis of the lever button on the one hand, but on the other hand, can also be arranged such that the helical spring acts as a compression spring and is loaded in the longitudinal direction.

In order to improve the guidance of the lever button in the catch device, according to a next configuration, it is provided that the clamp element has a recess for the catch projection of the lever button, especially that the clamp element surrounds the catch projection. The clamp element is positively connected to the sleeve, in the clamp element there being a recess which is open on one side or a closed recess which at least partially surrounds the catch projection. Preferably, the catch projection is completely surrounded with respect to its circumference by the recess. The catch projection is guided through this recess in the clamp element, as a result of which among others the stability of the lever button is increased during a pivoting process, specifically by the catch projection of the lever button not being able to yield laterally since this movement is stopped by the recess.

The stability of the pivoting process according to another configuration is additionally improved in that the clamp element has a stabilization bridge which is located centrally on the clamp element, especially that the stabilization bridge is located parallel to the longitudinal extension of the sleeve. The stabilization bridge is preferably located in the middle between and parallel to the two catch flanks. In the mounted state the stabilization bridge extends between two guide flanks which are provided on the lever button so that the pivot axis of the lever button is additionally protected against tilting. Preferably, the guide flanks are arranged orthogonally to the pivot axis so that the pivot axis passes through the guide flanks as a normal to the plane. It is also advantageously provided that laterally on the two guide flanks there is one part of the pivot axis so that the pivot axis does not extend completely on one piece through the lever button, but consists of at least two component regions.

The mounting of the catch devices according to a further configuration can be simplified in that the sleeve comprises at least one first half shell and at least one second half shell, especially that the lever button, the reset spring and the clamp element are located on the first half shell. The sleeve encompasses the vacuum cleaner suction pipe around its entire circumference in the mounted state, the sleeve comprising a first half shell and a second half shell which are each turned over one end region of the vacuum cleaner suction pipe and are locked to one another. The catch device is functionally mounted on the first half shell by the clamp element being locked positively to the sleeve, especially to the first half shell so that the lever button is pivotally held, as a result of which the catch projection can be pivoted between a locking position and a release position.

The catch device is preferably mounted on a two-part vacuum cleaner suction pipe, specifically on a vacuum cleaner suction pipe which comprises an inner pipe and an outer pipe, the inner pipe and the outer pipe being able to telescope relative to one another. In this way, the length of the vacuum cleaner suction pipe can be flexibly adjusted.

In particular, there is a host of possibilities for configuring and developing the catch device in accordance with the invention as will become apparent from the following description of preferred exemplary embodiments in conjunction with the drawings.

DETAILED DESCRIPTION OF THE INVENTION

Figure 1:
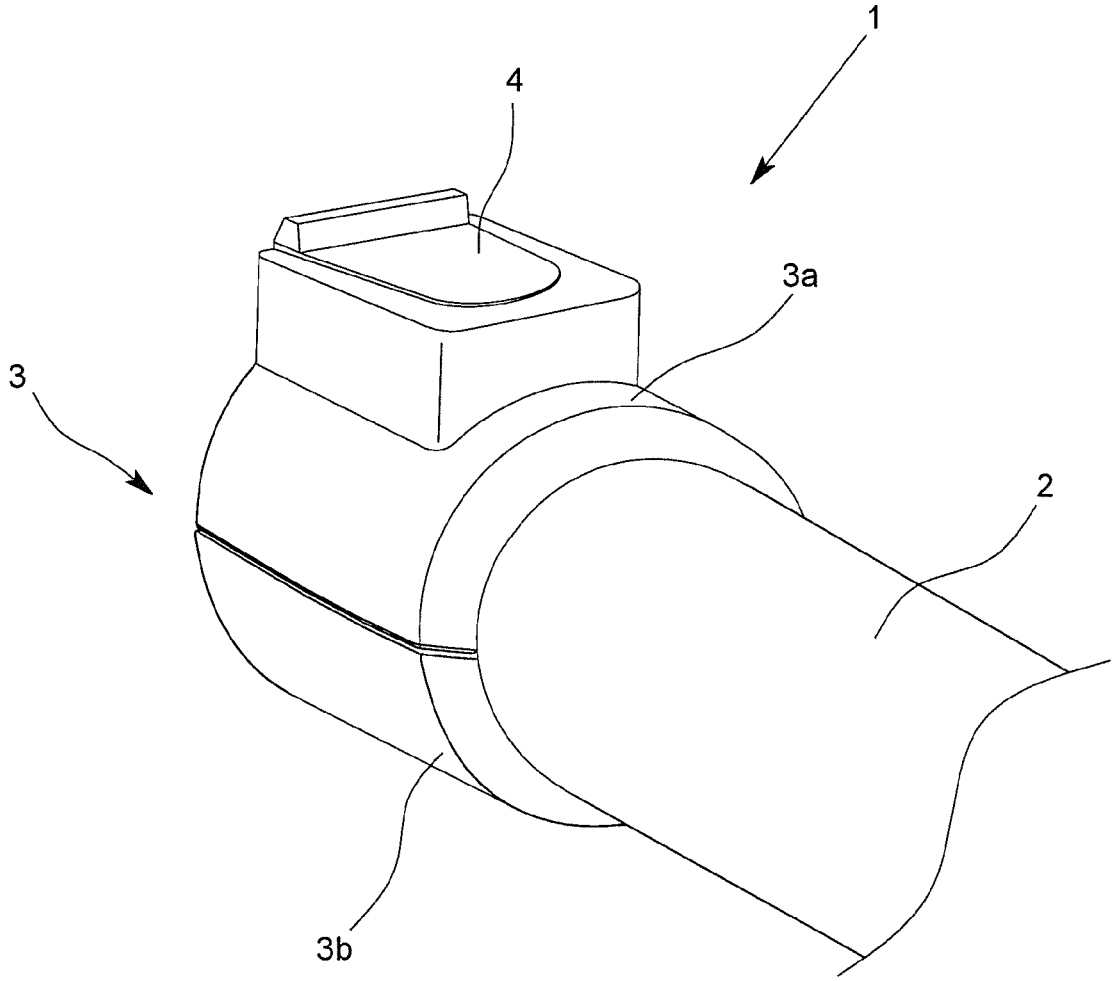
FIG. 1 is a perspective view of an exemplary embodiment of a catch device in the mounted state on a vacuum cleaner suction pipe.

FIG. 1 shows an exemplary embodiment of a catch device 1 for connecting a handle (not shown) to a vacuum cleaner suction pipe 2. The catch device 1 is mounted in an end region of the vacuum cleaner suction pipe 2 and comprises a sleeve 3 with a lever button 4. The sleeve 3 comprises a first half shell 3*a* and a second half shell 3*b* which surround the vacuum cleaner suction pipe 2 around its entire circumference at one end region. The first half shell 3*a* and the second half shell 3*b* are locked to one another. The lever button 4 is in a locking position as shown in FIG. 1.

Figure 2:
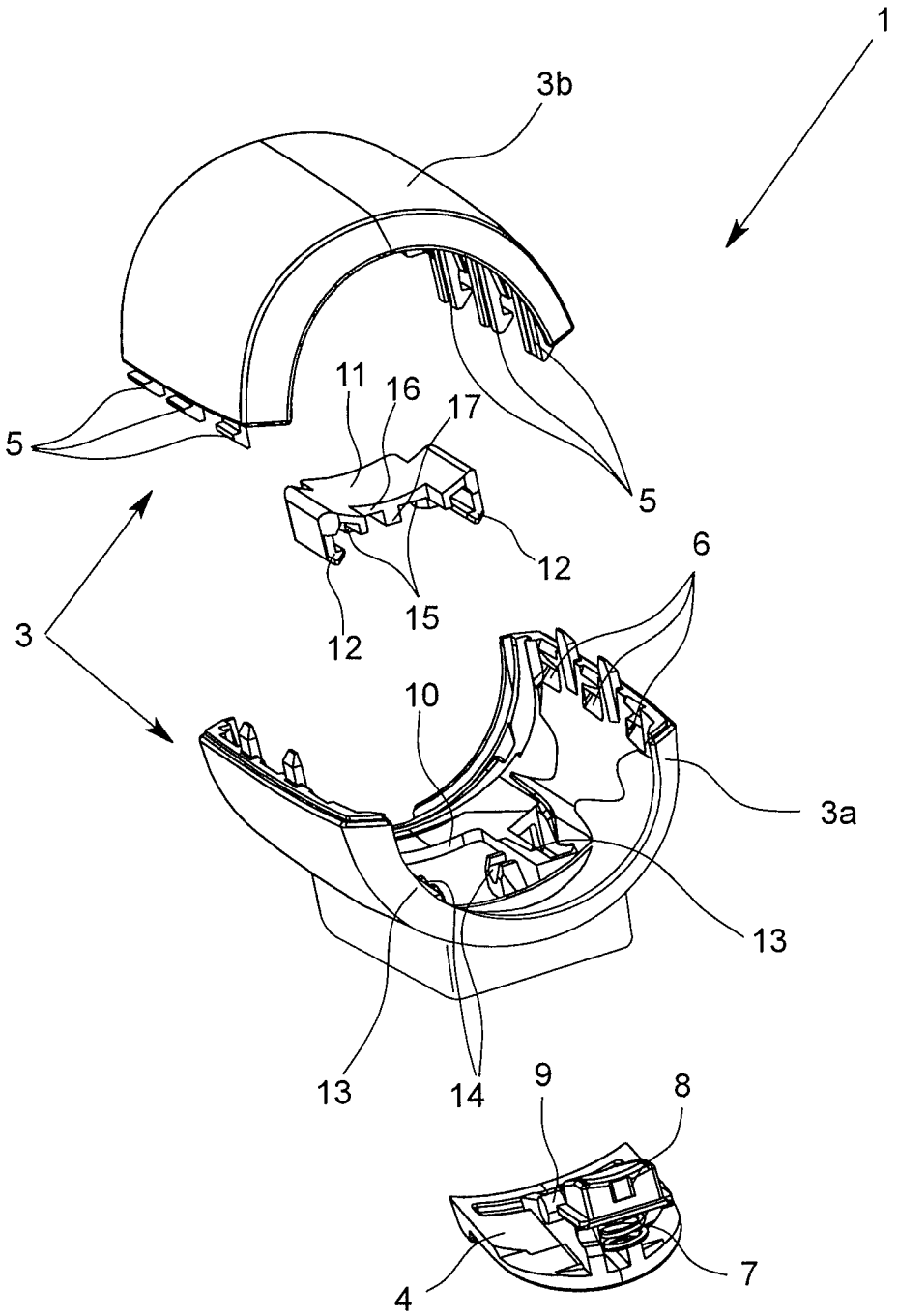
FIG. 2 is an exploded view of an exemplary embodiment of a catch device.

FIG. 2 is an exploded perspective view of an exemplary embodiment of a catch device 1. The first half shell 3*a* and the second half shell 3*b* of the sleeve 3 can be locked to one another by means of catch hooks 5 and corresponding catch recesses 6. The lever button 4 is shown together with a reset spring 7 that is located underneath the first half shell 3*a* between a catch projection 8 and lever button 4. The catch projection 8 is connected to the underside of lever button 4 by a pivot axle 9 which forms a pivot axis for pivoting movement of the catch projection 8.

For mounting purposes, the lever button 4 is inserted at least partially through an opening 10 into the sleeve 3 and is fixed with a clamp element 11 with respect to its position, specifically by the clamp element 11 being connected positively to the sleeve 3, by the clamp element 11 locking to the sleeve 3, especially the first half shell 3*a*. Then, the lever button 4 is held to be able to pivot around pivot axle 9 between the clamp element 11 and the sleeve 3. For attachment to the sleeve 3, the clamp element 11 has two catch flanks 12 which run parallel to one another and which interact with corresponding catch regions 13 on the sleeve 3 by the catch flanks 12 extending positively behind the catch regions 13. Both the catch flanks 12 and also the catch regions 13 are arranged such that they run parallel to the longitudinal extension of the sleeve 3, especially orthogonally to the pivot axis 9.

The clamp element 11 is located on the inside of the sleeve 3, especially on the inside of the first half shell 3*a* of the sleeve 3 so that the clamp element 11 in the mounted state is facing the vacuum cleaner suction pipe. To guide the pivot axis 9 of the lever button 4, on the sleeve 3, two first parts 14 of a guide bush are made into which the pivot axle 9 of the lever button 4 is placed. The first parts 14 of a guide bush partially surround the pivot axle 9 in the mounted state. In order to fix, the position of lever button 4 in the mounted state, but at the same time to enable a pivoting capacity, two second parts 15 of a guide bush are made on the clamp element 11 so that the pivot axle 9 of the lever button 4 is held in the mounted state, but is able to pivot between the first parts 14 of the guide bush and the second parts 15 of the guide bush.

The lever button 4 can be pivoted in the mounted state between a locking position and a release position. Here, the catch projection 8 is always pressed in the direction of the catch position by the reset spring 7 which is supported between the lever button 4, namely the catch projection 8, and the inner side of the sleeve 3, namely the first half shell 3*a*. For better guidance of the catch projection 8 of the lever button 4, the clamp element 11 has a recess 16 for the catch projection 8, which recess guides the catch projection 8 at three sides in the mounted state.

Figure 3:
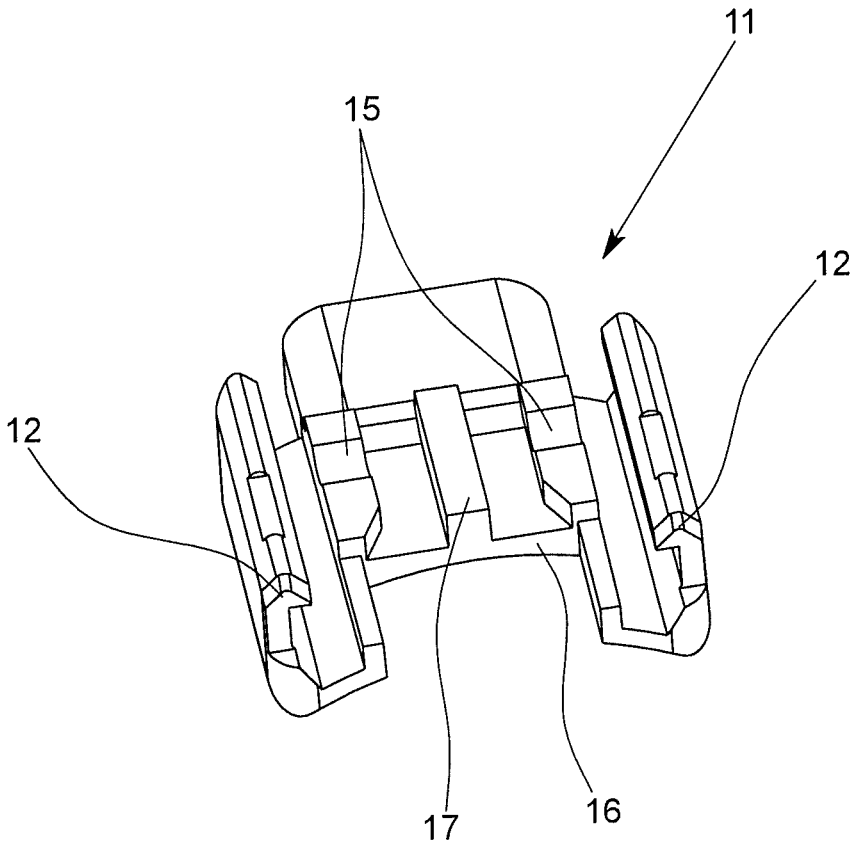
FIG. 3 is a perspective view of an exemplary embodiment of a clamp element.

FIG. 3 shows an exemplary embodiment of a clamp element 11 in a perspective view. The two catch flanks 12 are located parallel to one another and run in the edge regions of the clamp element 11. The catch projections of the catch flanks are opposite and pointing towards one another. Between the catch flanks 12 there are the two second parts 15 of a guide bush for guiding the pivot axis of one lever button. A stabilization bridge 17 is provided parallel to the catch flanks 12, centrally on the clamp element 11, and it is located between two guide flanks of the lever button in the mounted state, and in this way, ensures reliable guidance of the lever button.

Figure 4:
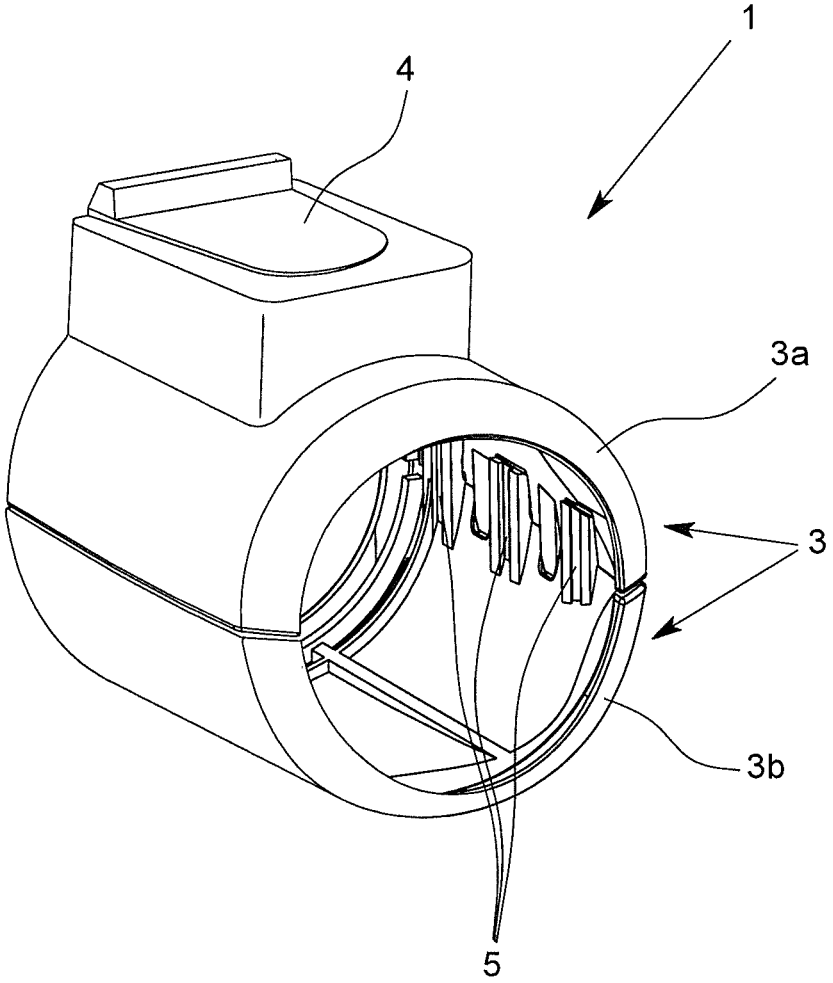
FIG. 4 is a perspective view of an exemplary embodiment of a catch device in the assembled state without the vacuum cleaner suction pipe.

FIG. 4 shows the exemplary embodiment of catch device 1 in the assembled state of the sleeve 3, specifically of the first half shell 3*a* and the second half shell 3*b* connected to each other, without a vacuum cleaner suction pipe. The lever button 4 is mounted in the first half shell 3*a* and can be actuated by pressure on its upper side, as a result of which it pivots out of the illustrated locking position into a release position, as a result of which the catch projection of the lever button 4 releases a positive connection.

Figure 5:
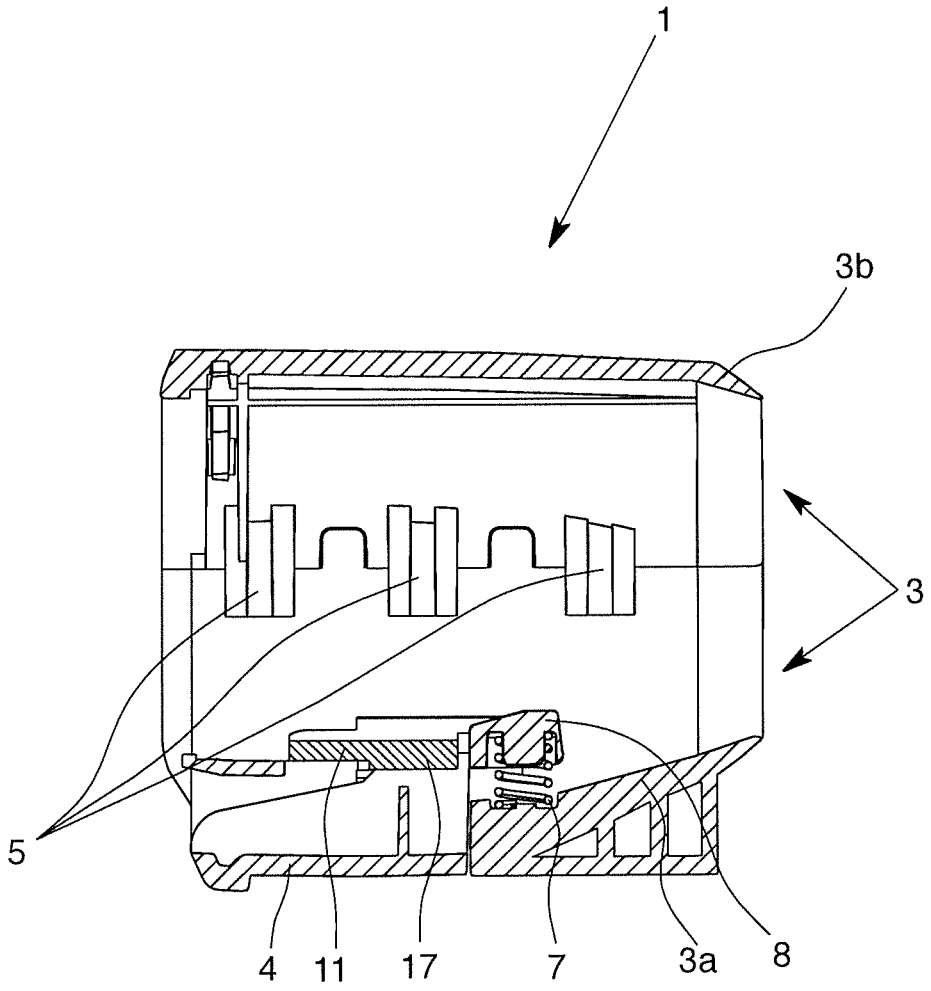
FIG. 5 shows one exemplary embodiment of a catch device.

FIG. 5 is a section view in a plane extending in the longitudinal direction of the catch device 1. The catch device 1 is shown assembled without the vacuum cleaner suction pipe, specifically, the first half shell 3*a* and the second half shell 3*b* of the sleeve 3 are connected. The catch projections 5 of the second half shell 3*b* are locked to the corresponding catch recesses 6 of the first half shell 3*a*. The catch projection 8 is in a locking position and is held by the reset spring 7 which is supported, on the one hand, on the sleeve 3, and on the other, on the catch projection 8 in this locking position.

By actuating the lever button 4 to pivot around the pivot axle 9, the catch projection 8 is moved into a release position, specifically by the catch projection 8 pivoting in the direction of the sleeve 3, especially in the direction of the first half shell 3*a*, as a result of which the reset spring 7 is compressed. As soon as the lever button 4 is released by a user, the reset spring 7 causes a reset of the catch projection 8, and thus, the lever button 4 into the illustrated locking position. A handle (not shown) can be inserted from the left in FIG. 5 into the catch device 1. The handle would first press the catch projection 8 back out of the locking position into the release position so that the catch projection 8 can then lock positively to a catch recess on the handle by the catch projection 8 returning into its locking position.

The stabilization bridge 17 stabilizes the lever button 4 when pivoting around the pivot axle 9, it being held in its position by the clamp element 11 which is mounted from the inside of the sleeve 3.

What is claimed is:

1. A catch device for connecting a handle to a vacuum cleaner suction pipe, wherein the catch device is mountable on a end region of a vacuum cleaner suction pipe, comprising:

at least one sleeve, at least one manually depressible lever button mounted at an inner side of the sleeve so as to be depressible from an outer side of the sleeve to pivot about a pivot axle, and at least one reset spring, wherein the sleeve is a carrier for the at least one manually depressible lever button and the at least one reset spring, wherein the lever button comprises a catch projection, wherein a clamp element is directly connected to the sleeve, wherein the pivot axle is pivotally held in a fixed position being clamped between the clamp element and the sleeve, wherein the clamp element has two catch flanks which are located parallel to one another, and wherein the sleeve has two catch regions which correspond to the catch flanks.

2. The catch device as claimed in claim 1, wherein the catch flanks run parallel to an axial direction of the sleeve.

3. The catch device as claimed in claim 1, wherein the clamp element is located on an inner side of the sleeve so that the clamp element, in a mounted state of the catch device will face the vacuum cleaner suction pipe.

4. The catch device as claimed in claim 1, wherein the reset spring is supported between the sleeve and the lever button, wherein the reset spring acts on the lever button to force it toward a locking position.

5. The catch device as claimed in claim 1, wherein the clamp element has a recess for the catch projection.

6. The catch device as claimed in claim 1, wherein the clamp element has a stabilization bridge for guidance of the lever button.

7. The catch device as claimed in claim 6, wherein the stabilization bridge is arranged extending parallel to the axial direction of the sleeve.

8. The catch device as claimed in claim 1, wherein the sleeve comprises at least one first half shell and at least one second half shell.

9. The catch device as claimed in claim 8, wherein the lever button, the reset spring and the clamp element are located on the first half shell.

10. A catch device for connecting a handle to a vacuum cleaner suction pipe, wherein the catch device is mountable on a end region of a vacuum cleaner suction pipe, comprising:

at least one sleeve, at least one manually depressible lever button mounted at an inner side of the sleeve so as to be depressible from an outer side of the sleeve to pivot about a pivot axle, and at least one reset spring, wherein the sleeve is a carrier for the at least one manually depressible lever button and the at least one reset spring, wherein the lever button comprises a catch projection, wherein a clamp element is directly connected to the sleeve, wherein the pivot axle is pivotally held in a fixed position being clamped between the clamp element and the sleeve, and wherein at least one first part of a guide bush for the pivot axle is located on the sleeve and at least one second part of the guide bush is located on the clamp element so that the pivot axle of the lever button is guided in the guide bush between the clamp element and the sleeve.

11. A vacuum cleaner suction pipe assembly, comprising at least one vacuum cleaner suction pipe, a catch device for connecting a handle to the vacuum cleaner suction pipe, wherein the catch device is mountable on a end region of a vacuum cleaner suction pipe, comprising:

at least one sleeve, at least one manually depressible lever button mounted at an inner side of the sleeve so as to be depressible from an outer side of the sleeve to pivot about a pivot axle, at least one reset spring, wherein the sleeve is a carrier for the at least one manually depressible lever button and the at least one reset spring, wherein the lever button comprises a catch projection, wherein a clamp element is directly connected to the sleeve, wherein the pivot axle is pivotally held in a fixed position being clamped between the clamp element and the sleeve, wherein the clamp element has two catch flanks which are located parallel to one another, and wherein the sleeve has two catch regions which correspond to the catch flanks.

* * * * *